US012084866B2

(12) United States Patent
Chich et al.

(10) Patent No.: US 12,084,866 B2
(45) **Date of Patent: *Sep. 10, 2024**

(54) FASTENING SYSTEMS FOR ATTACHING FABRIC TO A ROOF DECK

(71) Applicant: BMIC LLC, Dallas, TX (US)

(72) Inventors: Adem Chich, Kearny, NJ (US); Yan Zheng, Livingston, NJ (US)

(73) Assignee: BMIC LLC, Dallas, TX (US)

( * ) Notice: Subject to any disclaimer, the term of this patent is extended or adjusted under 35 U.S.C. 154(b) by 92 days.

This patent is subject to a terminal disclaimer.

(21) Appl. No.: 17/901,266

(22) Filed: Sep. 1, 2022

(65) Prior Publication Data

US 2023/0077282 A1 Mar. 9, 2023

Related U.S. Application Data

(63) Continuation of application No. 17/207,860, filed on Mar. 22, 2021, now Pat. No. 11,434,638.

(60) Provisional application No. 62/993,336, filed on Mar. 23, 2020.

(51) Int. Cl.

| | |
|---|---|
| ***E04D 11/02*** | (2006.01) |
| ***E04D 5/12*** | (2006.01) |
| ***E04D 5/14*** | (2006.01) |

(52) U.S. Cl.

CPC ..... *E04D 11/02* (2013.01); *E04D 5/12* (2013.01); *E04D 5/145* (2013.01)

(58) Field of Classification Search

None

See application file for complete search history.

(56) References Cited

U.S. PATENT DOCUMENTS 2,207,897 A * 7/1940 Schaus ..... F16B 15/06 411/456
4,502,256 A * 3/1985 Hahn ..... E04D 5/143 52/63
4,543,758 A * 10/1985 Lane ..... E04D 5/146 52/716.2

(Continued)

FOREIGN PATENT DOCUMENTS

CN 109563867 B 1/2021
EP 0894910 A2 2/1999

(Continued)

OTHER PUBLICATIONS

EBAY; https://www.ebay.com/itm/4-4-Solar-Self-Seal-Roof-Mounting-Brackets-Unistrut-Superstrut-Rail-standoffs-/151271225082; 4) 4+" Solar Self Seal Roof Mounting Brackets Unistrut/Superstrut Rail Standoffs; available prior to Sep. 30, 2019.

(Continued)

*Primary Examiner* — Joshua K Ihezie

(74) *Attorney, Agent, or Firm* — Womble Bond Dickinson (US) LLP

(57) ABSTRACT

Fastener systems for roofing systems are disclosed for fastening a fabric, mesh, or base sheet to a roof deck prior to application of a liquid applied roof coating. The fastening assemblies may be attached to an uncleaned or unprimed roof deck and a fabric is laid atop the fasteners. The fasteners secure the fabric using mechanical binding or chemical bonding without penetrating or dimpling the fabric.

15 Claims, 7 Drawing Sheets

(56) References Cited

U.S. PATENT DOCUMENTS 4,546,580 A * 10/1985 Ueno ..... E04F 15/02476 52/126.1
4,565,724 A 1/1986 Smits
4,651,490 A * 3/1987 Marston ..... E04D 15/04 52/716.2
4,663,909 A * 5/1987 Ogino ..... E04D 11/005 52/263
4,744,187 A 5/1988 Tripp
4,841,706 A * 6/1989 Resan ..... B29C 66/72321 52/410
4,852,323 A * 8/1989 Kartfilt ..... E04D 5/147 52/410
4,854,105 A * 8/1989 Delisle ..... E04D 5/147 52/410
4,862,664 A * 9/1989 Romine ..... E04D 5/143 411/383
5,035,028 A * 7/1991 Lemke ..... E04D 5/147 24/336
5,094,056 A * 3/1992 Peters ..... F16B 21/183 52/410
5,193,326 A * 3/1993 Sheahan ..... G01M 3/04 52/698
5,204,148 A * 4/1993 Alexander ..... E04D 5/145 52/514
5,236,164 A * 8/1993 Lorizzo ..... F16G 11/00 248/343
5,304,023 A 4/1994 Toback et al.
5,347,768 A * 9/1994 Pineda ..... E04D 1/34 52/DIG. 11
5,457,920 A 10/1995 Waltz
5,472,241 A 12/1995 Kosik, Jr. et al.
5,528,872 A 6/1996 Rotter
5,593,748 A * 1/1997 Hubbard ..... C09J 7/21 428/354
5,647,178 A 7/1997 Cline
5,785,478 A 7/1998 Rotter
5,800,891 A * 9/1998 Wasitis ..... E04D 5/145 428/40.1
5,907,938 A * 6/1999 Sheahan ..... E04D 5/145 411/536
6,282,858 B1 9/2001 Swick
6,298,613 B1 10/2001 Coulton et al.
6,418,678 B2 7/2002 Rotter
6,460,304 B1 * 10/2002 Kim ..... E04D 5/12 52/746.1
6,536,729 B1 3/2003 Haddock
6,640,511 B1 * 11/2003 Link ..... E04D 5/147 52/410
7,222,463 B2 5/2007 Rotter
7,329,077 B2 2/2008 Curtis
7,384,331 B2 6/2008 Coulton
7,793,479 B2 * 9/2010 Kelly ..... E04D 11/02 52/309.7
8,424,821 B2 4/2013 Liu
8,689,517 B2 4/2014 Schaefer et al.
8,920,088 B1 12/2014 Garvin
9,945,414 B1 * 4/2018 Rodenhouse ..... F16B 43/001
9,995,333 B2 * 6/2018 McPheeters ..... F16B 33/004
10,017,943 B1 * 7/2018 Zhou ..... C09D 183/04
10,291,176 B2 5/2019 Wentworth et al.
10,633,863 B2 * 4/2020 Freeman ..... E04D 5/06
11,035,130 B1 * 6/2021 Arguelles ..... F16B 15/02
11,434,638 B2 9/2022 Chich et al.
11,434,683 B2 9/2022 Chich
2002/0066235 A1 * 6/2002 Stearns ..... E04G 21/328 52/24
2003/0033783 A1 * 2/2003 Kobetsky ..... E04D 5/14 52/410
2004/0132401 A1 7/2004 Rotter
2004/0200170 A1 10/2004 Fabel
2005/0066621 A1 3/2005 Fritz
2006/0053702 A1 * 3/2006 Kelly ..... E04D 13/1643 52/90.1
2007/0054612 A1 3/2007 Ehrman et al.
2007/0079865 A1 4/2007 Warfield et al.
2007/0107347 A1 5/2007 Haynes et al.
2008/0148669 A1 6/2008 Ehrman et al.
2009/0049769 A1 2/2009 Kaseda
2010/0126066 A1 * 5/2010 DeVos ..... E04D 11/002 47/65.9
2011/0173908 A1 * 7/2011 Kahle ..... E04D 5/08 52/273
2011/0250034 A1 * 10/2011 Swanson ..... F16B 5/0692 411/103
2011/0272545 A1 * 11/2011 Liu ..... F24F 13/32 248/222.14
2014/0260036 A1 * 9/2014 Freeman ..... E04D 7/00 52/412
2016/0069067 A1 * 3/2016 Ciuperca ..... E04B 1/7633 52/309.8
2017/0175395 A1 * 6/2017 Freeman ..... E04D 11/002
2019/0194948 A1 * 6/2019 Nill ..... F16B 9/02
2020/0248455 A1 * 8/2020 Chich ..... E04D 1/2914
2021/0095473 A1 * 4/2021 Zheng ..... B32B 25/10
2021/0095475 A1 4/2021 Zheng et al.
2021/0254343 A1 * 8/2021 Zheng ..... D06M 15/564

FOREIGN PATENT DOCUMENTS

EP 2662646 A1 11/2013
WO WO2012/153246 A1 11/2012

OTHER PUBLICATIONS

International Search Report and the Written Opinion of the International Searching Authority for PCT/US2021/023418, Mailed Jul. 27, 2021.
Extended European Search Report regarding related Application No. 21775346.6 dated Mar. 4, 2024.

* cited by examiner

FASTENING SYSTEMS FOR ATTACHING FABRIC TO A ROOF DECK

REFERENCE TO RELATED APPLICATIONS

The present patent application is continuation of co-pending U.S. patent application Ser. No. 17/207,860, filed Mar. 22, 2021, which claims priority to and the benefit of U.S. Provisional Patent Application No. 62/993,336, filed Mar. 23, 2020.

INCORPORATION BY REFERENCE

The disclosures of U.S. patent application Ser. No. 17/207,860, filed Mar. 22, 2021, and U.S. Provisional Patent Application No. 62/993,336, filed Mar. 23, 2020, are specifically incorporated by reference herein as if set forth in their entireties.

TECHNICAL FIELD

This disclosure relates generally to roofing systems, and more specifically to roofing installation systems for attaching a fabric substrate to a roof deck or substrate to receive a subsequent liquid applied roof coating.

BACKGROUND

Mechanically bonded liquid applied roofing (LAR) systems require installation of an appropriate fabric, mesh or base-sheet (hereinafter referred to collectively as fabric) on a roof deck using mechanical fasteners. The fasteners usually include washer-like fastener plates that are positioned on top of the fabric and are attached with nails or screws driven through the fabric and into the underlying roof deck. Problems with such traditional fabric attachment techniques include such fastener plate edges cutting into and damaging the fabric, shadow areas around the fasteners that are not effectively sealed by a subsequently applied liquid roof coating, and unwanted penetrations of the fabric. A need exists for a roofing system that successfully addresses these and other problems and shortcomings. It is to the provision of such a system that the present disclosure is primarily directed.

SUMMARY

Briefly described, example roofing systems including a plurality of fastening assemblies are disclosed for attaching a fabric to a roof deck prior to application of an LAR coating. The fastening assemblies may be installed on an uncleaned or unprimed roof deck prior to laying a fabric on the roof. In some embodiments, the fastening assemblies may reside underneath the fabric and may utilize mechanical binding or chemical bonding to secure the fabric without piercing the fabric. The disclosed fastening assemblies and roofing systems in which they are employed according to the principles of the present disclosure can provide various advantages including increased efficiency and reliability, elimination of shadow areas or dimples or bumps in the fabric, efficiencies in the number of fasteners, and ease of fabric installation.

Various aspects, features, and advantages of the present disclosure include, without limitation a fastening system for attaching overlying fabric to a roof deck. In embodiments, the fastening system comprises a plurality of first elements configured to be secured to the roof deck and a plurality of second elements for securing the overlying fabric to the plurality of first elements without piercing the fabric.

In some embodiments of the fastening system, each of the plurality of first elements comprises a base and each of the plurality of second elements comprises a binding material on the base, the binding material configured to soften when heated sufficient to bond with the fabric. In embodiments, the binding material resides on top of the base. In other embodiments, the binding material resides below the base; and the base comprises openings to allow the binding material to flow through the base when heated.

In additional embodiments of the fastening system, the plurality of second elements comprise locking tabs extending upwardly from each of the plurality of first elements, the locking tabs being configured to attach mechanically to the overlying fabric. In embodiments, each of the locking tabs comprises a cap configured to snap into an open area of the overlying fabric. In further embodiments, each cap is cone-shaped.

In other embodiments the fastening system, the plurality of second elements comprise attachment plates configured to reside atop the fabric, the attachment plates being securable to the plurality of first elements. In some embodiments, the plurality of first elements have upstanding alignment tabs and studs that extend through open areas of the overlying fabric, and the plurality of second elements include openings spaced and sized to receive the upstanding alignment tabs and studs; and with the fasteners comprising nuts threadable onto the studs to secure the attachment plates to the first elements.

In still other embodiments of the fastening system, the plurality of first elements comprise grommets mountable in pre-drilled holes in the roof deck. In embodiments, the grommets are internally threaded; and wherein the plurality of second elements comprise threaded fasteners with heads. In other embodiments, the plurality of second elements comprise attachment plates configured to be positioned between the threaded fasteners and the fabric.

In other aspects of the present disclosure, a roofing system is disclosed, comprising a roof deck; a plurality of first elements positioned along the roof deck; a fabric positioned over the roof deck and the plurality of first elements; a plurality of second elements configured for securing the fabric to the plurality of first elements without piercing the fabric; and at least one fastener inserted through the first and second elements, the roof deck, the fabric and so as to couple the first and second elements together; wherein the fabric is captured and held against the roof deck by the first and second elements.

In some embodiments of the roofing system each of the plurality of first elements comprises a base and each of the plurality of second elements comprises a cover plate adapted to seat upon the base, with the fabric engaged and held therebetween. In embodiments, each base further comprises at least one stud and plurality of alignment tabs projecting from a surface of each base, and wherein at least one stud and the alignment tabs are configured to extend at least partially through open areas of the fabric and the cover plate; with the at least one stud being engaged by one of the fasteners to secure each of the cover plates to a corresponding one of the bases.

In other embodiments of the roofing system, each base comprises a grommet having a barrel inserted into the roof deck and an attachment flange projecting radically from a first end of the barrel and adopted to seat upon a surface of the roof deck; and wherein each of the fasteners is configured to be received within a barrel of one of the grommets.

In embodiments, the plurality of second elements comprise attachment plates configured to be positioned over the attachment flanges of the grommets; wherein the attachment plates are secured to the grommets by insertion of the fasteners therethrough.

In some embodiments of the roofing system, the fabric comprises at least one of a permeable mesh, woven fabric, non-woven fabric, plastic, foam material or combinations thereof; and includes a plurality of open areas configured to enable at least partial penetration of a liquid roof coating therein.

In other embodiments of the roofing system, the plurality of first elements each comprise a plurality of alignment tabs and studs that extend through open areas of the fabric; and wherein the plurality of second elements each comprise a plurality of openings configured to receive at least a portion of the alignment tabs and the studs of a corresponding one of the first elements, and wherein the fasteners comprise nuts threadable onto the studs to secure each of the second elements to the corresponding one of the first elements.

In some embodiments of the roofing system, the plurality of first elements comprise grommets received within pre-drilled holes in the roof deck and mounted to the roof deck; wherein the grommets are internally threaded, and wherein the fasteners each comprise threaded fasteners to engage internal threads of the grommets. In addition, the second elements comprise attachment plates configured to be positioned between the threaded fasteners and the fabric.

In embodiments, the roofing system further comprises a liquid applied roof coating (LAR) applied over the fabric; wherein the liquid applied roof coating at least partially penetrates the fabric to form a liquid applied roof.

In some embodiments of the roofing system, the roof deck comprises a plurality of panels, sheets, boards, or combinations thereof, including metal, isocyanurate board (ISO), modified bitumen, wood, oriented strand board, membrane materials, cement, or combinations thereof.

In another aspect of the present disclosure, a method is provided, comprising positioning a plurality of first elements at spaced locations along a roof deck; placing a fabric over the plurality of first elements and the roof deck; wherein the fabric includes a plurality of open areas defined therealong; positioning a plurality of second elements over the plurality of first elements, with at least one fastener extending through each of the first and second elements and into the roof deck; wherein the fabric is captured and held against the roof deck between the first and second elements; and applying a liquid applied roof (LAR) coating over the fabric and roof deck; wherein the liquid applied roof coating at least partially penetrates the fabric.

In embodiments, the LAR coating penetrates through open spaces defined in the fabric, and coats the fabric. In some embodiments, the LAR coating penetrates through the open spaces of the fabric and into fibers of the fabric, so as to be at least partially absorbed by the fabric as well as coating the fabric and passing through the open spaces thereof.

In other embodiments of the method, the first elements each comprise a base having a plurality of alignment tabs and studs configured to be received through a portion of the open areas of the fabric; the second elements each comprise a cover plate having a plurality of openings therein; and wherein positioning the second elements over the first elements comprises aligning the openings formed in one of the cover plates with the alignment tabs and at least one stud of a corresponding one of the bases; and fitting each of the cover plates over their corresponding bases with at least the studs projecting through the openings of the attachment plates and secured with nuts.

In other embodiments of the method, the first elements comprise grommets and the second elements comprise attachment plates; and further comprising inserting a barrel of each grommet into an opening in the roof deck; aligning an opening formed in each attachment plate with an opening formed in a corresponding one of the grommets, and inserting one of the fasteners therethrough.

Accordingly, embodiments of fastening systems and methods for attaching fabric materials to a roof deck prior to application of an LAR coating to form a roof structure that are directed to the above discussed and other needs are disclosed. The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Figure 1B:
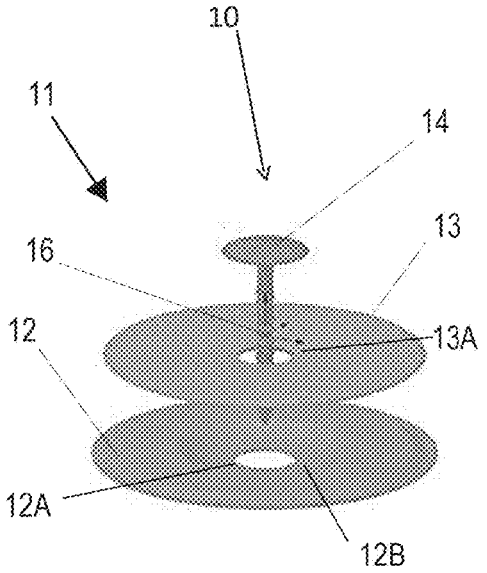
FIG. 1B is an isometric exploded view of the fastening assembly of FIG. 1A.
Figure 1A:
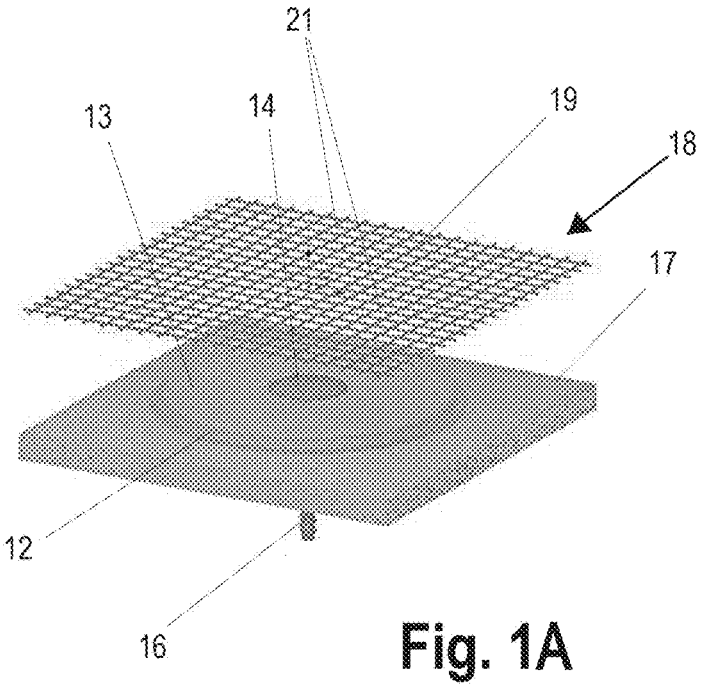
FIG. 1A is an isometric exploded view of an example fastening assembly for a roofing system that embodies principles of the present disclosure.
Figure 2:
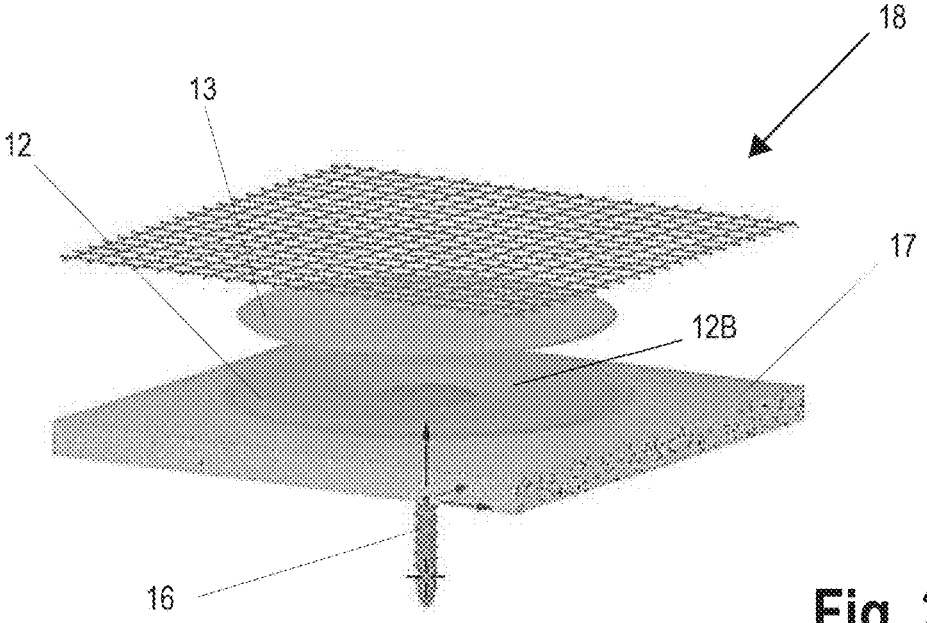
FIG. 2 is an isometric partially exploded view of the fastening assembly of FIGS. 1A-1B.

Reference will now be made to the drawing figures wherein reference numerals indicate various elements throughout the several drawings. FIGS. 1A-2 show a first embodiment of the present disclosure. Generally, a fastening assembly 11 is shown for use in a roofing system 10 for fastening a fabric 18 to a roof deck 17 prior to application of an LAR coating to a roof. It will be understood that the roofing systems 10 can include commercial, residential, and/or other types of roofing systems utilizing LAR coatings. In addition, the fastening assemblies may be attached to an uncleaned or unprimed roof deck.

In this embodiment, the fastening assembly includes a first element that can include a washer-shaped base 12 be positioned on the roof deck, and has a second element comprising a binding material 13 that is received atop the base 12. A fastener such as a nail or screw 16, is extendable through central openings 12A/13A of the base 12 and the binding material 13 and will be driven into a roof deck. In some embodiments, the base 12 further has a central depression 12B within which the head 14 of the nail or screw 16 resides so that it does not form a bump or dimple in the fabric 18. Other types of fasteners for mechanically attaching the fabric also can be used.

As illustrated in FIGS. 1A and 2, the fastening assembly 11 of this embodiment is attached to a roof deck 17 by driving the nail or screw 16 through the binding material 13, through the base 12, and into the roof deck 17. As indicated in FIGS. 1A-1B, in some instances, the binding material 13 can be formed as a ring, or can have other configurations, and generally will be sized and shaped to fit over and substantially cover the base 12. The binding material also can be formed with an opening 13A (as shown in FIG. 1B) that can be aligned with the opening 12A of the base 12 for insertion of the nail or screw 16 therethrough. Other configurations, including sheets and/or other shapes with or without an opening for receipt of the nail or screw therethrough, also can be used. In some embodiments, the fastening assembly 11 is attached at a plurality of spaced locations along the roof deck 17 (FIGS. 1A and 2).

In embodiments, the fabric 18 will have crisscrossing strands 19 forming open areas 21, and is applied over the roof deck covering the installed fastening assemblies 11. As indicated in FIGS. 1A-2, the fabric 18 will be configured to absorb and/or enable penetration of at least a portion of an LAR coating therethrough to form an LAR coated roof. For example, in embodiments, the fabric 18 can comprise a permeable textile material such as a mesh, woven fabric, non-woven fabric, foam material, or combinations thereof. Other permeable, porous or semi-porous materials, including but not limited to, screens, webs, scrim materials, or combinations thereof also can be used. The fabric also can be formed from various materials, including, but not limited to, foam materials, metals, composites, natural and/or synthetic fibrous materials, or combinations thereof.

The binding material 13 can be heated or otherwise treated (such as with a solvent) until it melts or softens, flows through the open areas of the fabric, and binds to the strands 19. The fabric 18 is thus securely attached to the roof deck at a plurality of locations without penetrations, bumps, shadows, or dimples in the fabric. The LAR coating can then be applied atop the attached fabric. Examples of LAR coatings that can be used in various embodiments include, but are not limited to silicone, acrylate, polyurethane, polyurea, silane terminated polyurethane, silane terminated polyether, silane terminated polyethylene, polyvinylidene fluoride or polyvinylidene difluoride (PVDF), or combinations thereof.

As shown in FIGS. 1A-2, the fastening assembly of this embodiment comprises a washer-shaped base 12 covered by a layer of binding material 13. The washer-shaped base can comprise a material such as metal, plastic, ceramic, rubber, or combinations of such materials. In some embodiments, the thickness of the binding material covering the washer-shaped base 12 may be from 10 mils to 200 mils. In some embodiments, the thickness can be 10 mils to 100 mils; 10 mils. to 75 mils.; and/or 10 mils. to 50 mils.; and in further embodiments, the thickness of the binding material can be 10 mils. to 50 mils.; 10 mils. To 25 mils; and/or 10 mils. to 20 mils. In other embodiments, the thickness of the binding material can be 20 mils. to 200 mils; 20 mils. to 100 mils; 20 mils. to 75 mils; 20 mils. to 50 mils; and/or 20 mils. to 30 mils. In further embodiments, the thickness of the binding material can range from 50 mils. to 200 mils; 50 mils. to 100 mils; 50 mils. to 75 mils; 100 mils. to 200 mils; and/or 100 mils to 150 mils. Other varying thicknesses of the binding material covering the washer-shaped base 12 also can be used depending application, roof installation, environment and other factors.

The binding material 13 may be, but is not limited to, a thermoset material with setting temperature that may be from 60° to 400° Centigrade, or a thermal plastic material with softening temperature that may range from 60° to 400° Centigrade. In some embodiments, a thermoset material with a setting temperature in a range from 60° to 200° Centigrade, 80° to 300° Centigrade, or 80° to 400° Centigrade; or a thermal plastic with a softening temperature in a range from 60° to 200° Centigrade also could be used. In other embodiments, a thermoset material with a setting temperature in a range from 80° to 200° Centigrade, 80° to 300° Centigrade, or 80° to 400° Centigrade; or a thermal plastic with a softening temperature in a range from 80° to 200° Centigrade, 80° to 300° Centigrade, or 80° to 400° Centigrade also could be used.

Other thermoset, thermo plastic, and/or other heat setting or binding materials, or combinations thereof, also can be used. Examples of such binding materials may include, without limitation, phenolic formaldehyde, epoxy, polyester, polyimide, phenolic neoprene, or combinations thereof.

The base 12 and binding material 13 may be delivered as separate pieces or pre-assembled. The fastening assemblies may be installed on roof decks or substrates that can include, but are not limited to, panels, sheets, boards, or combinations thereof, and which can be formed from metal, isocyanurate board (ISO), modified bitumen, wood, oriented strand board, membrane materials, cement, or combinations thereof, and can be provided with or without coating layers on top (collectively referred to herein as a roof deck).

The fastening assemblies may be secured to the roof deck 11 with fasteners such as nails or a screws 16. The fabric will be applied on the upper surface of the roof deck so that it covers over the attached fastening assemblies. The binding materials are then treated with direct or indirect heat to a temperature above their setting or softening temperature with the fabric pressed against the fastening assemblies. The binding materials are allowed to cool down and solidify to complete the bond between the fastening assemblies and the fabric. In some embodiments detailed herein, the binding materials can be chemically treated to complete the bond between the fastening assemblies and the fabric.

The installation sequence also can be modified by installing a plurality of metal or plastic bases and first applying or inserting a fastener, such as a nail or screw, through openings defined in each base and into the roof deck, as indicated in FIG. 1A; then applying the binding material on top of the bases before laying down the fabric and softening the binding materials.

Figure 3:
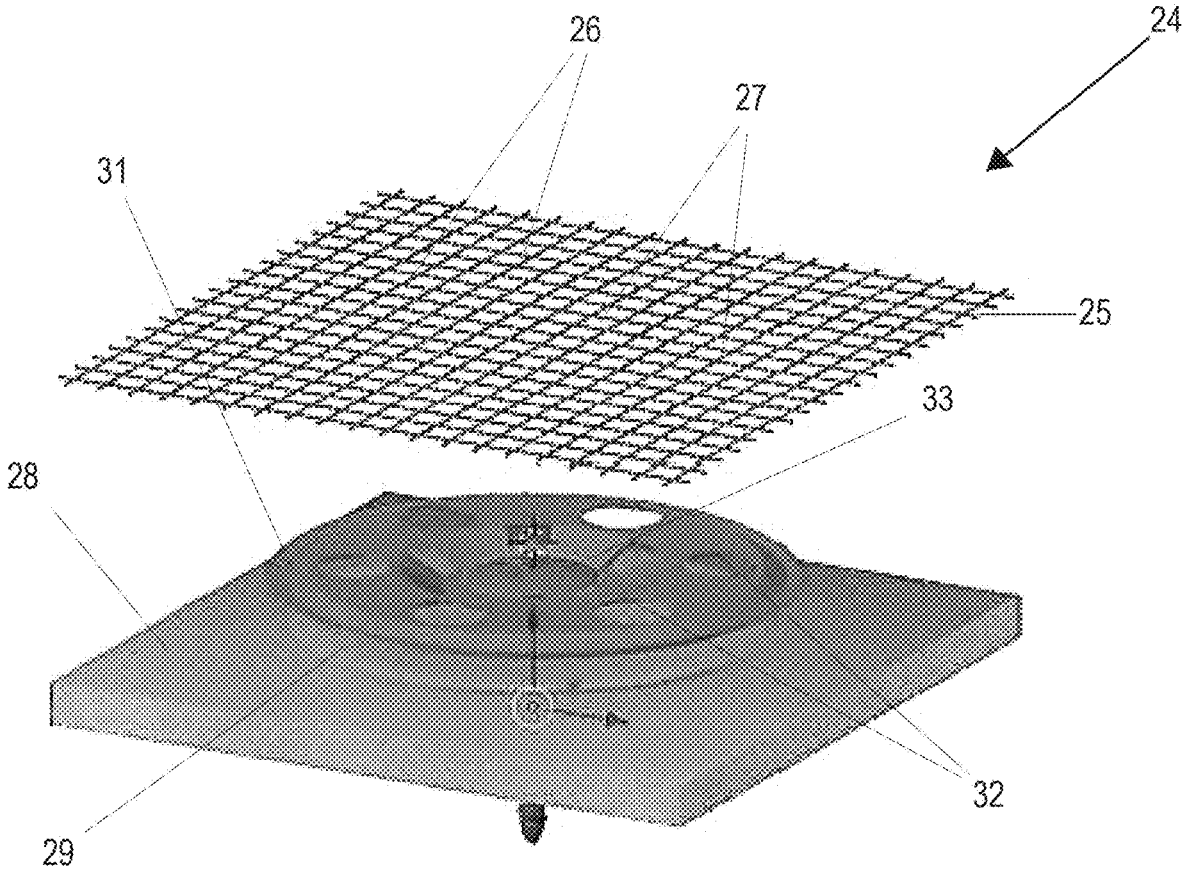
FIG. 3 is an isometric exploded view of another example fastening assembly for a roofing system that embodies principles of the present disclosure.
Figure 4A:
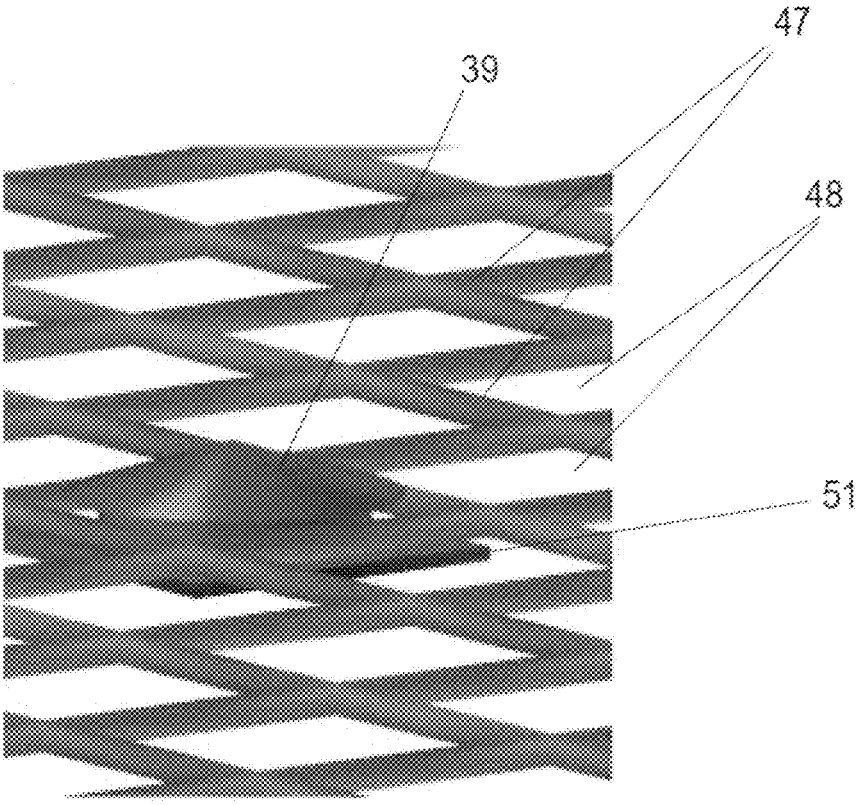
FIG. 4A is an isometric view of an another example fastening assembly that embodies principles of the present disclosure.
Figure 4C:
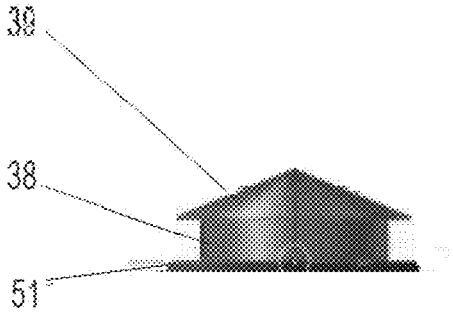
FIG. 4C is a side view of a locking tab of the fastening assembly of FIG. 4A.
Figure 4B:
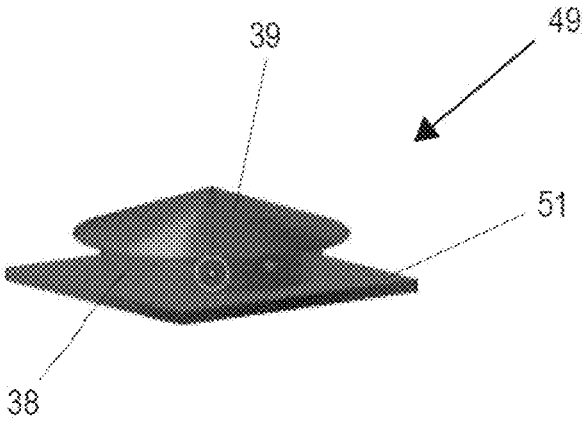
FIG. 4B is an isometric view of a locking tab of the fastening assembly of FIG. 4A.
Figure 4D:
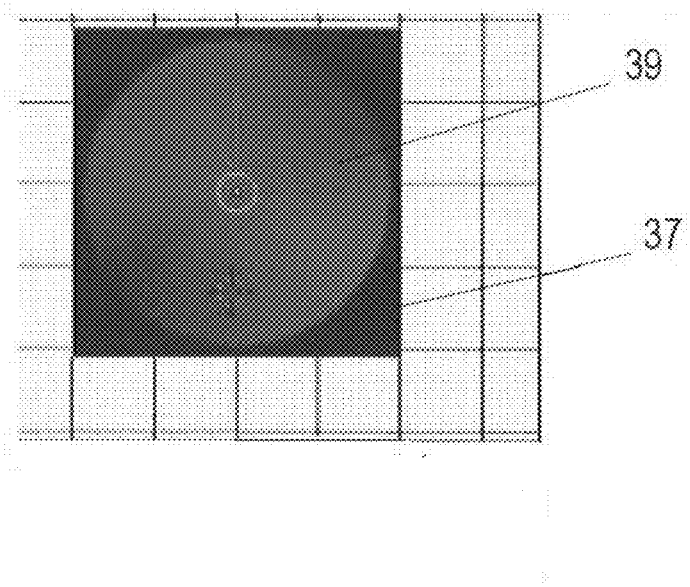
FIGS. 4D-4E are plan views of a locking tab of the fastening assembly of FIG. 4A.
Figure 4E:
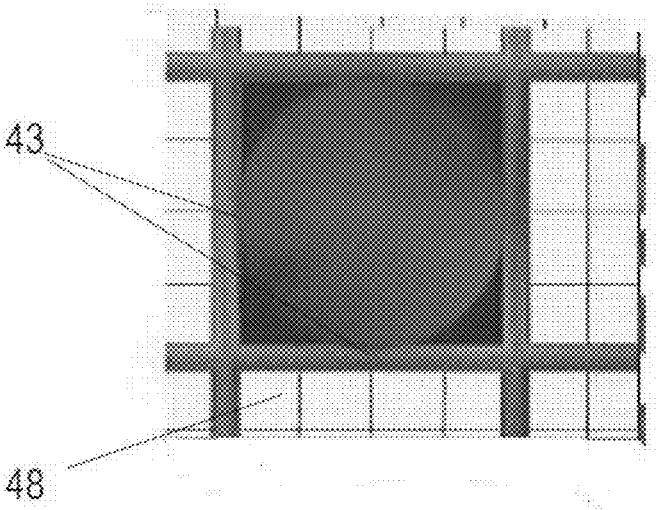
Figure 4F:
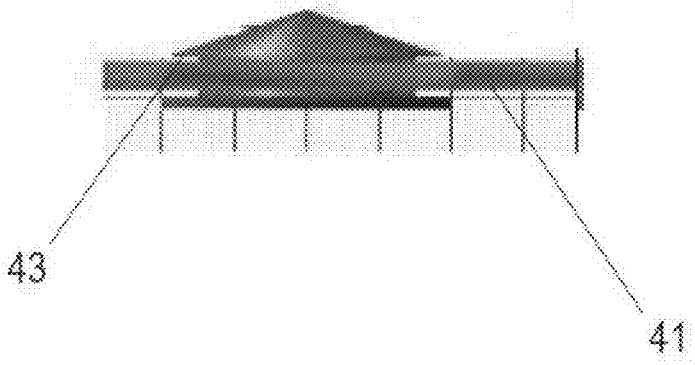
FIG. 4F is side view of a locking tab of the fastening assembly of FIG. 4A engaged with a fabric.

FIG. 3 shows another embodiment of a fastening assembly 24 for use in securing a fabric 25 to a roof deck 28 as part of a roofing system, having a first element that can comprise a layer of binding material 29 is disposed below second element, here shown as comprising a washer-shaped metal or plastic base 31 having openings 32. Again, a depression is formed in the middle of the base within which the head 33 of the nail or screw resides to avoid bumps and dimples in an overlying fabric. In some embodiments, the depression is formed in an area of the base between the middle and the edge of the base. A fabric 25, such as discussed above, having crisscrossing strands 26 forming open areas 27 is laid on the roof deck 28 covering a plurality of installed fastening assemblies. The fastening assemblies are then heated to a temperature above their setting or softening temperatures. As it softens, the binding material 29 flows through the openings 32 to engage, adhere to, and form a bond with the fabric above.

The combined areas of the openings 32 in the base 31 of this embodiment may be between 50% and 90% of the total area of the base. In some embodiments, the combined areas of the openings 32 in the base can be between 50% and 80%. In some embodiments, such as for use of plastic and/or rubber materials, the combined areas of the openings 32 in the base can be between 50% and 70%; 50% and 60%; or 50% and 55%. In some embodiments, such as for use of metal and/or ceramic materials, the combined areas of the openings 32 in the base can be between 70% and 90%; 70% and 80%; 70% and 75%; or 60% and 70%. Other combinations also can be provided.

The binding material, once heated and allowed to cool and re-solidify, forms a bond both with the base 31 and the fabric for a secure attachment. If the base 31 is made of metal, induction heating can be used to heat the binding material without using direct heat and without contacting the binding material 29. The binding material may be chosen so that it may be softened with a chemical solvent and allowed to re-cure for form the bond without heating.

Figure 5:
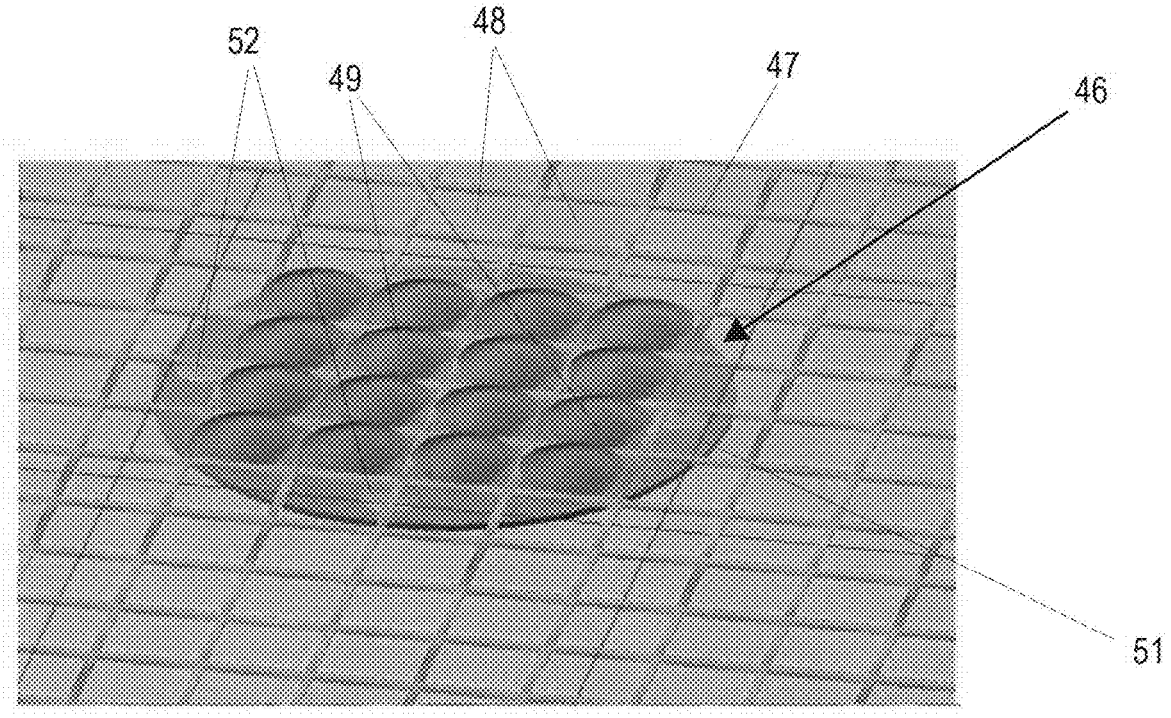
FIG. 5 is an isometric view of a fastening assembly for a roofing system incorporating locking tabs, such as shown in FIGS. 4A-4F, that embodies principles of the present disclosure.
Figure 6:
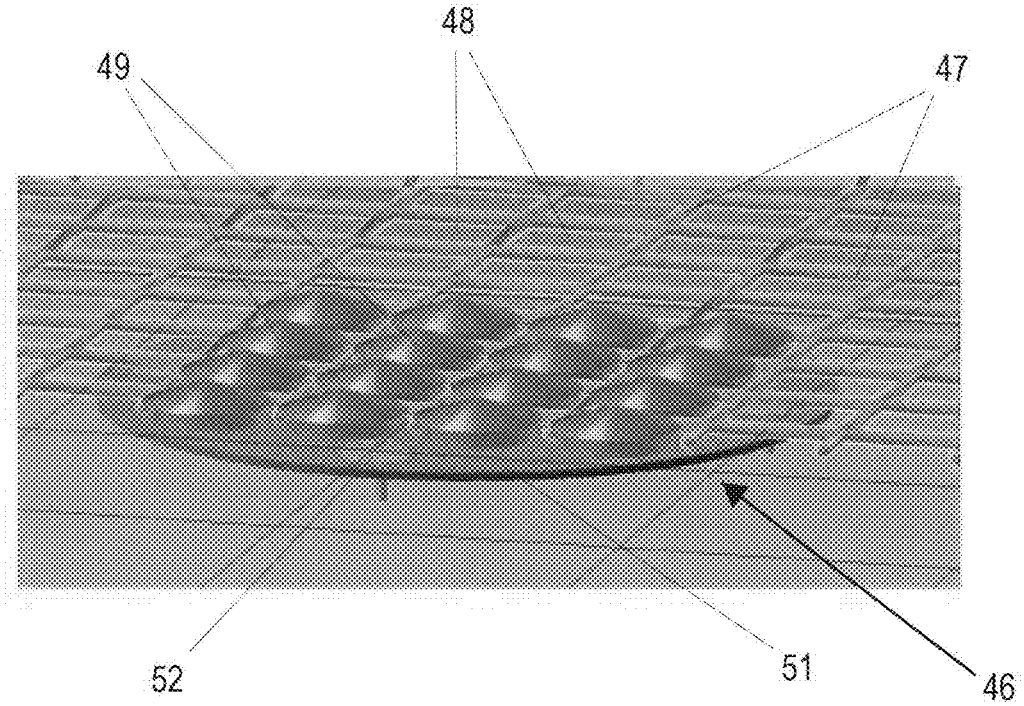
FIG. 6 is an isometric view of the fastening assembly of FIG. 5 with the fabric partially cut away to reveal the attachment mechanism.

FIGS. 4A-6 show another embodiment of a fastening assembly for use in securing a fabric to a roof deck as part of a roofing system according to the present disclosure wherein the fabric is secured mechanically to a plurality of fastening assemblies pre-installed on a roof deck. Referring first to FIGS. 5 and 6, each fastening assembly 46 has a first element comprising a base 51 from which a second element comprising a plurality of locking tabs 49 extends upwardly. Referring to FIGS. 4A-4F, each of the locking tabs 49 projecting upwardly from the base 51 is formed with a neck 38 and a cone-shaped cap 39. In some embodiments, the cap 39 has a diameter greater than the diameter of the neck 38.

With continued reference to the embodiment shown in FIGS. 4A-4F, the neck 38 of each locking tab 49 has a diameter less than the length and width of the open areas 48 formed by crisscrossing strands 47 of the fabric. The cap 39 of each locking tab has a diameter greater than the length and width of the open areas 48 of the fabric. With this configuration, when the fabric is pressed onto each one of the pre-installed fastening assemblies, each of the caps 39 of the locking projections 49 extend through one of the open areas 48 of the fabric.

Once received through the open areas 48, the peripheral edges of the caps 39 overlap a portion of the strands 47 bordering the openings as shown at 43 in FIGS. 4A-4F. The strands rest below the caps 39 adjacent the neck 38 of the locking tab 49. A mechanical lock is thus established between each of the projecting locking tabs 49 and the fabric to secure the fabric to the fastening assembly and to the roof deck without further treatment. As shown in FIGS. 5 and 6, a plurality of fastening assemblies 46 may be secured to a roof deck at spaced locations using fasteners such as nails or screws 52. Fabric is then laid on the roof overlying the installed fastening assemblies and pressed onto each fastening assembly to force the locking tabs through the fabric thereby mechanically attaching the fabric to the roof deck.

Figure 7:
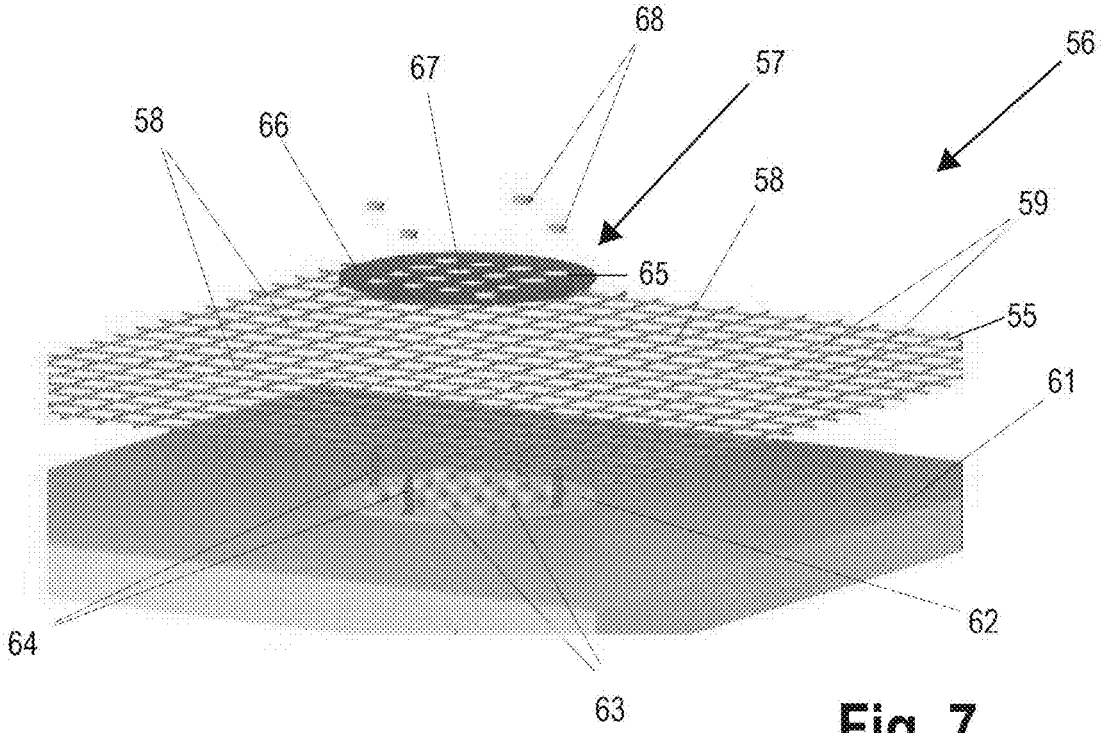
FIG. 7 is an isometric exploded view of another example fastening assembly for a roofing system that embodies principles of the present disclosure.
Figure 8:
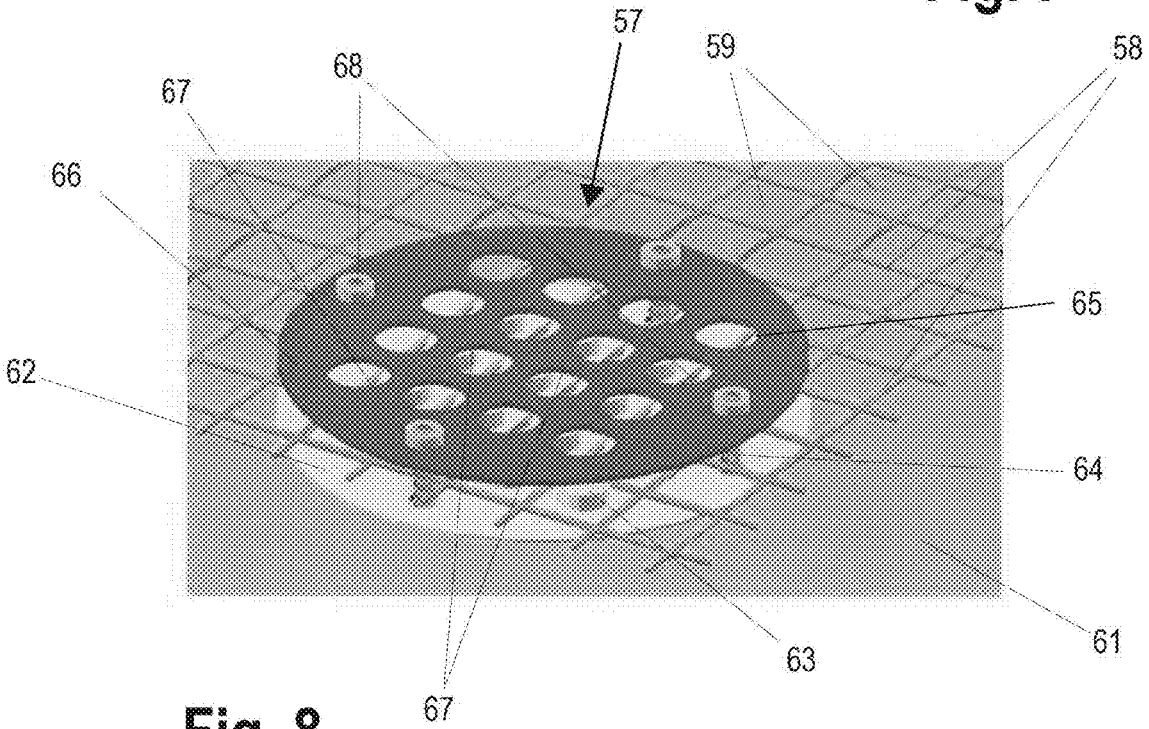
FIG. 8 is an isometric view of the example fastening assembly of FIG. 7 shown fastening a fabric to a roof deck.

FIGS. 7 and 8 illustrate an alternate embodiment of a fastening assembly 56 for use in securing a fabric 55 to a roof deck 61 as part of a roofing system according to principles of the present disclosure. In this embodiment, the fastening assembly 56 employs two components, including a plurality of first elements each positioned beneath the fabric 55 and a plurality of second elements, each positioned above the fabric.

As illustrated in FIG. 7, each of the first elements of the fastening assembly 56 of this embodiment comprises a base 62 that is secured to a roof deck 61 with nails or screws, or with an adhesive. The base thus will be secured to the upper surface of the roof deck 61 to provide a substantially water tight seal between the base and the roof deck. In embodiments, the base can include a plate or sheet formed from various metals, composites or synthetic materials or combinations thereof, and in some embodiments, can be coated with a binding material.

As shown in FIG. 7, a plurality of alignment tabs 63 project upwardly from the base 62, and will be configured to project though open areas 59 defined in the fabric. While the alignment tabs are shown in FIGS. 7-8 as having a substantially cylindrical construction, other shapes or configurations also can be used. In some embodiments, the alignment tabs have diameters less than the length and width of the open areas 59 formed by crisscrossing strands 58 of the fabric 55. Threaded studs 64 are attached to the base and project upwardly from the base 62, with the studs generally being positioned at spaced locations around the periphery of the base.

In some embodiments, the studs can comprise fasteners that further serve to fasten one or more components of the roof deck together and/or to a rafter or other support of the roof as well as attaching the base to the roof deck. For example, as discussed above, the roof deck can include panels or sheets of metal, isocyanurate boards (ISO), modified bitumen, wood, membranes, cement, or combinations thereof, as well as other types of sheets, panels or boards, with or without coating layers on top. In some non-limiting embodiments, such as where ISO boards or similar roof deck materials are used, a first end or portion of one or more of the studs can be inserted through each base and through the roof deck, securing both the base and the roof deck together and to an underlying support, without necessarily requiring separate and/or additional fasteners to first attach the roof deck to a support, then to attach the bases to the roof deck.

Each of the second elements of the fastening assembly can include a cover plate 66 that has openings 65 sized and configured to receive the alignment tabs 63 of the base 62 when the cover plate is aligned over and laid atop the base 62. The cover plate 66 also has holes 67 defined therein that will be positioned to receive the threaded studs 64 of the base 62. The cover plate 66 can be attached to the base 62 by lowering it onto the base until the threaded studs, and the alignment tabs of the base, extend through their respective holes in the cover plate 66. The cover plate 66 is then secured to the base with fasteners such as nuts 68 or other connectors threaded onto to the ends of the threaded studs, as shown in FIG. 8. Once secured, the alignment tabs 63 of the base plate 62 extend through open areas of the fabric 55 and at least partially through the openings 67 of the cover plate 66.

In use, a plurality of bases 62 are secured to a roof deck 61 at spaced locations. The fabric 55 is then laid on the roof deck and positioned as desired. The upstanding alignment tabs 63 and threaded studs 64 extend through open areas of the fabric to hold the fabric in position until permanently secured, such as with an LAR coating. With the fabric held in place, cover plates 66 are installed on top of the fabric overlying each of the installed bases 62, and being secured with nuts 68. The fabric becomes securely fastened to each of the fasteners due to the alignment tabs 63 extending through open areas of the fabric and into their respective openings 67 in the overlying cover plate 66, with the fabric being captured and held between the first and second elements of the fastening assembly 56. An LAR coating will be applied, at least, partially penetrating or being absorbed into the fabric and thereafter curing to form an LAR coated roof structure.

Figure 9A:
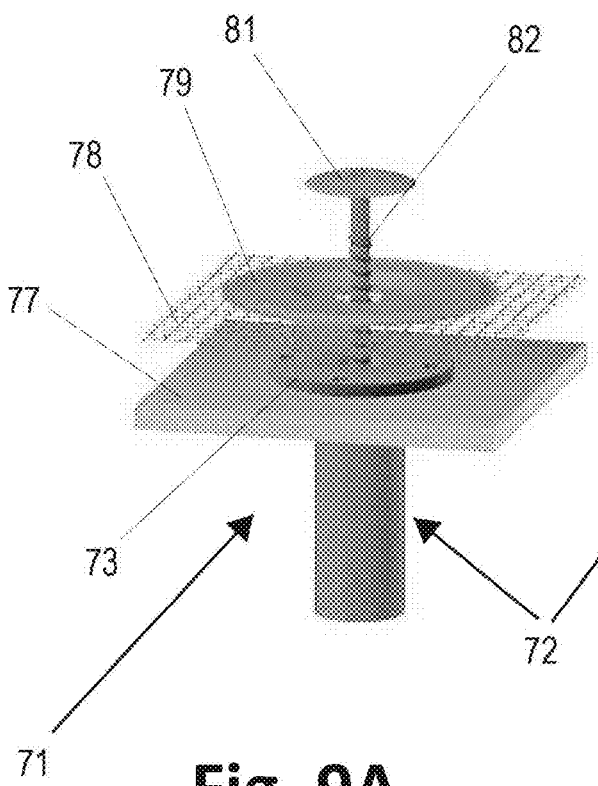
FIG. 9A is an isometric view of another example fastening assembly for a roofing system that embodies principles of the present disclosure.
Figure 9B:
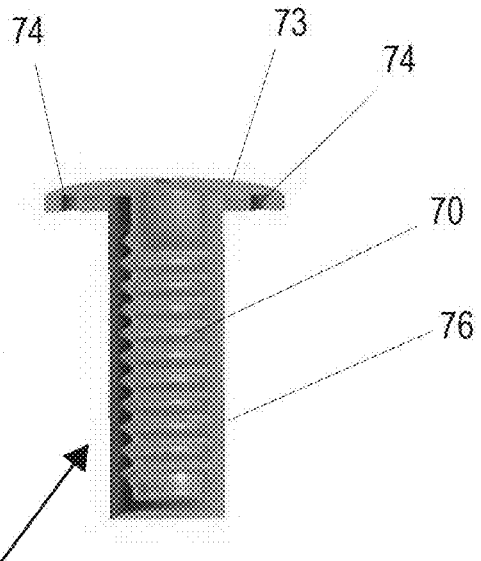
FIG. 9B is a cross sectional view of the fastening assembly of FIG. 9A.

FIG. 9A shows still another embodiment of a fastening assembly 71 for use in securing a fabric 78 to a roof deck 77 as part of a roofing system according to principles of the present disclosure. In this embodiment, the fastening assembly 71 can include a plurality of first elements, each comprising a grommet 72 (FIG. 9B) that has a hollow barrel 76 with internal threads 70. An attachment flange 73 projects radially outwardly from the top of the barrel 76 of each grommet of each grommet and has attachment holes 74 formed about its periphery.

As illustrated in FIG. 9A, each of the grommets 72 is sized to be inserted through a pre-drilled hole in a roof deck 77, and can be secured with nails or screws, or other fasteners driven through the attachment holes 74. In other embodiments, the grommets further can be attached to the roof deck after insertion into a hole therein by use of adhesives. The grommets will be engaged and affixed to the roof deck, with their attachment flanges in substantially tight bearing engagement so as to create a substantially water-tight seal between their attachment flanges and the upper surface of the roof deck.

The fastening assembly 71 further will include a plurality of second elements, each of which can comprise a metal or plastic washer-shaped attachment plate 79 that is securable to a corresponding one of the installed grommets 72 using a threaded fastener 82 (e.g. a screw, bolt, or similar threaded fastener) having a head 81. The threads of the fastener 82 will engage with the internal threads 70 formed in the barrel of the grommet 72 to provide a mechanical connection therebetween. As with previously described embodiments, the attachment plate 82 has a central recess configured to receive the head of the fastener 82 in a substantially seated engagement to avoid bumps or dimples in the installed fabric.

In use, a plurality of grommets 72 are installed in spaced, pre-drilled holes in the roof deck 71 (FIG. 9A). Fabric 78 is then laid onto the roof deck covering the installed grommets. Attachment plates 79 are positioned on top of the fabric overlying each of the grommets and are secured to their corresponding ones of the grommets with a threaded fastener 82. The fabric thus is securely attached to the roof deck at a plurality of locations between the flanges 73 of the grommets and the attachment plates 79. The attachment plates 79 may have slightly downturned peripheral edges to press the fabric firmly against the roof deck around the attachment flanges 73 of the grommets 72. After the fabric is secured to the roof deck, an LAR coating will be applied over the fabric. The LAR coating will penetrate and/or be at least partially absorbed into the fabric such that the fabric will hold and restrain migration or flowing of the LAR coating along the roof deck, and thereafter will cure to a liquid applied roof structure.

The fastening assemblies for use in roofing systems according to the present disclosure enable the formation of liquid applied roof structures that can be mechanically bonded to an underlying roof deck, providing protection against water and wind uplift effects, while further enabling a minimization of the number of fasteners required. In addition, a need for substantial cleaning and/or priming of the roof deck prior to installation of the fabric and LAR coating further can be substantially avoided or minimized.

The foregoing description generally illustrates and describes various embodiments of the present disclosure. It will, however, be understood by those skilled in the art that various changes and modifications can be made to the above-discussed construction of the present disclosure without departing from the spirit and scope of the disclosure as disclosed herein, and that it is intended that all matter contained in the above description or shown in the accompanying drawings shall be interpreted as being illustrative, and not to be taken in a limiting sense. Moreover, while a variety of specific example roofing systems and fastening assemblies that embody principles and aspects thereof have been described in the present disclosure, it will be understood by the skilled artisan that a wide range of additions, deletions, and modifications, both subtle and gross, may well be made to the illustrated examples without departing from the spirit and scope of the present disclosure.

What is claimed is:

1. A roofing system, comprising:

a roof deck;

a fabric positioned over the roof deck, the fabric having a plurality of open areas; and a plurality of fastening assemblies, each comprising:

a first element positioned along the roof deck; and at least one second element positioned on the first element and configured to be received through at least one open area of the fabric;

wherein the at least one second element is integral with the first element;

wherein the fabric is positioned over the at least one second element and is captured between the at least one second element and the first element to establish a mechanical connection between the fabric and the roof deck; and wherein at least a portion of the at least one second element projects through the at least one open area of the fabric and remains exposed after the fabric has been installed.

2. The roofing system of claim 1, wherein the first elements of at least some of the plurality of fastening assemblies each comprise a base configured to attach to the roof deck; and the at least one second element comprises a tab projecting away from the base and having a size greater than a diameter, or a length and width, of the open areas of the fabric such that the fabric is captured between the tab and the base as the fabric is positioned over the tab.

3. The roofing system of claim 1, wherein the first element of each fastening assembly is positioned below the at least one second element of the fastening assembly; and wherein each of the first elements comprises a binding material adapted to at least partially flow through the open areas of the fabric sufficient to bond with the fabric.

4. The roofing system of claim 1, wherein the fabric comprises at least one of a permeable mesh, woven fabric, non-woven fabric, plastic, foam material or combinations thereof.

5. The roofing system of claim 1, further comprising a liquid applied roof coating applied over the fabric; and wherein the plurality of open areas of the fabric are configured to enable at least partial penetration of the liquid applied roof coating therethrough.

6. The roofing system of claim 1, wherein the first elements of the plurality of fastening assemblies each include a base, and the at least one second element comprises a tab configured to project through the open areas of the fabric to form a mechanical connection between the fabric and the roof deck.

7. The roofing system of claim 6, wherein, the tabs each include a neck having a diameter less than a diameter, or a length and width, of the open areas of the fabric, and a cap having a diameter greater than the diameter, or the length and width of the open areas of the fabric.

8. The roofing system of claim 1, wherein the roof deck comprises a plurality of panels, sheets, boards, or combinations thereof, including metal, isocyanurate board (ISO), modified bitumen, wood, oriented strand board, membrane materials, cement, or combinations thereof.

9. A roofing system, comprising:

a roof deck;

a fabric positioned over the roof deck, the fabric having a plurality of open areas; and a plurality of fastening assemblies, each comprising:

a base positioned along the roof deck; and at least one tab positioned on the base and configured to be received through at least one open area of the fabric;

wherein the base is integral with the at least one tab;

wherein the at least one tab of each of the plurality of fastening assemblies is projected through the at least one open area as the fabric is positioned over the at least one tab and against the base such that the fabric is captured between the at least one tab and the base to establish a mechanical connection between the fabric and the roof deck; and wherein at least a portion of the at least one tab projecting through the at least one open area of the fabric and remains exposed after the fabric has been installed.

10. The roofing system of claim 9, wherein each of the fastening assemblies further comprises a cover plate received over each base, each cover plate including a plurality of openings configured to receive the at least one tab therethrough; and wherein the fabric is received between one or more of the bases and the cover plates to attach the fabric to the roof deck.

11. The roofing system of claim 10, further comprising at least one stud projecting upwardly from each base and configured to extend through at least one of the open areas of the fabric, and fasteners configured to engage upper ends of the studs; wherein the cover plates are secured to the bases by engagement of the fasteners with the studs to secure the fabric between the bases and the cover plates and to the roof deck.

12. The roofing system of claim 9, further comprising a liquid applied roof coating applied over the fabric; wherein the liquid applied roof coating at least partially penetrates the fabric to form a liquid applied roof.

13. The roofing system of claim 9, wherein the roof deck comprises a plurality of panels, sheets, boards, or combinations thereof, including metal, isocyanurate board (ISO), modified bitumen, wood, oriented strand board, membrane materials, cement, or combinations thereof.

14. The roofing system of claim 9, wherein, the at least one tab comprises a neck having a diameter less than a diameter, or a length and width, of the open areas of the fabric, and a cap having a diameter greater than the diameter, or the length and width, of the open areas of the fabric.

15. The roofing system of claim 9, wherein the fabric comprises at least one of a permeable mesh, woven fabric, non-woven fabric, plastic, foam material or combinations thereof.

* * * * *